US008498092B2

(12) United States Patent
Itani

(10) Patent No.: US 8,498,092 B2
(45) Date of Patent: Jul. 30, 2013

(54) AIR IONIZER ELECTRODE ASSEMBLY

(75) Inventor: Yukihiko Itani, Tokorozawa (JP)

(73) Assignee: Oxion, PTE, Ltd, Singapore (SG)

( * ) Notice: Subject to any disclaimer, the term of this patent is extended or adjusted under 35 U.S.C. 154(b) by 31 days.

(21) Appl. No.: 13/128,953

(22) PCT Filed: Dec. 23, 2008

(86) PCT No.: PCT/SG2008/000497

§ 371 (c)(1),
(2), (4) Date: May 12, 2011

(87) PCT Pub. No.: WO2010/074654

PCT Pub. Date: Jul. 1, 2010

(65) Prior Publication Data

US 2011/0216467 A1 Sep. 8, 2011

(51) Int. Cl.
*H01T 23/00* (2006.01)

(52) U.S. Cl.
USPC ..... 361/231

(58) Field of Classification Search
USPC ..... 361/231
See application file for complete search history.

(56) References Cited

U.S. PATENT DOCUMENTS

| | | | | |
|---|---|---|---|---|
| 4,519,357 | A | | 5/1985 | McAllister |
| 5,065,272 | A | * | 11/1991 | Owen et al. ..... 361/231 |
| 5,136,461 | A | | 8/1992 | Zellweger |
| 6,375,714 | B1 | | 4/2002 | Rump et al. |
| 7,365,965 | B2 | | 4/2008 | Higashikozono et al. |
| 7,438,747 | B2 | | 10/2008 | Luo |
| 2006/0130658 | A1 | | 6/2006 | Chang et al. |
| 2007/0012300 | A1 | | 1/2007 | Clack |

FOREIGN PATENT DOCUMENTS

| | | |
|---|---|---|
| DE | 10254135 | 6/2004 |
| JP | 200170837 | 5/1989 |
| JP | 7080349 | 3/1995 |
| JP | 2008310801 | 11/1996 |
| JP | 2003045611 | 2/2003 |
| JP | 20030417651 | 2/2003 |
| JP | 2004167391 | 6/2004 |
| JP | 2006187743 | 7/2006 |

OTHER PUBLICATIONS

Japanese Office Action, Notice of Reasons for Rejection; 2 pages, Feb. 5, 2013.

* cited by examiner

*Primary Examiner* — Stephen W Jackson
(74) *Attorney, Agent, or Firm* — Renner Kenner Greive Bobak Taylor Weber

(57) ABSTRACT

An air ionizer electrode assembly (10; 50; 60) comprising an inner electrode (11; 52; 66), at least one outer electrode (14, 15; 54; 61) and a dielectric barrier (12, 13; 53; 64) sandwiched between the inner electrode and the at least one outer electrode. The inner electrode has a continuous overall surface and the at least one outer electrode has a plurality of holes (21; 56; 70) to provide a plurality of ion generating points for generation of negative ions.

15 Claims, 6 Drawing Sheets

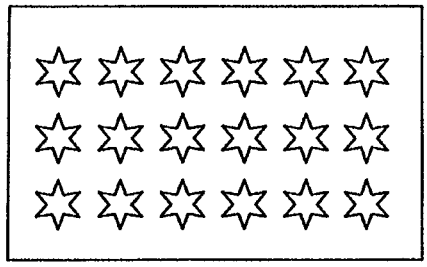
Fig 3a
Star (small) Configuration
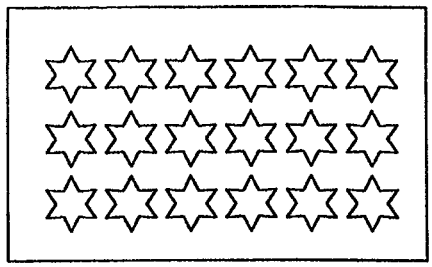
Fig 3b
Star Configuration
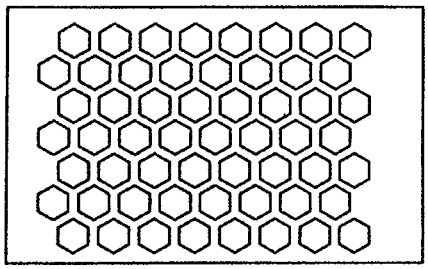
Fig 3c
Honeycomb Configuration
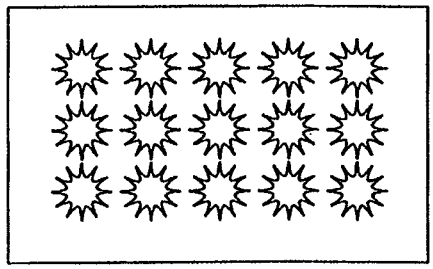
Fig 3d
Sun Configuration
Fig. 3
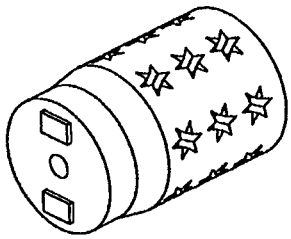
Iso View
Fig. 7

AIR IONIZER ELECTRODE ASSEMBLY

FIELD OF THE INVENTION

The invention relates generally to devices for the generation of negative ions in the air. More specifically, the invention concerns an electrode assembly for use in such devices.

BACKGROUND OF THE INVENTION

Over the last few decades negative air ions have been found to be an essential component of good air quality. These negative ions have been shown to have beneficial physiological effects on plants, animals and humans. Extensive research has concluded that abundant negative ions in an environment can enhance mood, improve metabolic activity, accelerate healing and increase performance in athletes. In addition, negative ions have been shown to have important air cleaning functions, such as removing harmful dust particles, remove odors and kill various micro-organisms.

Many conventional air ionizers employ a configuration of metal pins where the pins are a fixed part of the device and usually not easily replaceable. The pins tend to blunt with continued usage, since they are essentially functioning as sacrificial anodes. As the pins blunt, negative ion generation decreases significantly, resulting in insufficient negative ions being produced to be effective for their intended purposes. The rapidity of the pins being blunted means that replacement of the pins is frequently necessary thus adding to the cost and inconvenience of owning these products. This would mean that the effectiveness of the conventional ionizers with non-replaceable pins is over once the pins have blunted which can be a matter of weeks or months. Another area of consideration is the absence of modularity in ion generating devices. Common ion generating apparatus are designed for specific models or incorporated into other air cleaning products, making the ion generating devices more specific and limiting their usability across different markets.

U.S. Pat. No. 7,365,956 B2 discloses a generator for negative ions in the air at atmospheric pressure, in which two electrodes are respectively disposed in close proximity on either side of a barrier of dielectric material. The two electrodes have like structure, with each electrode having holes in it. The electrodes may both be of metallic mesh, or both electrodes may be deposited directly onto the barrier surface and done in a pattern, irregular or ordered, such that there are regions where the conductor is absent. The pattern may be a cross-hatch pattern.

U.S. Pat. No. 7,438,747 B2 discloses a negative ion generator that includes a flat dielectric layer having a planar surface and a plurality of conductive lines attached to the planar surface to define a plurality of ion-discharging points. A high-voltage generating circuit is coupled to the conductive lines for actuating the emission of electrons from the ion-discharging points. In one described configuration, a conductive mesh screen has a plurality of punched cutouts of different shapes.

Japanese patent publication JP 2004-167391 A discloses an electrostatic air cleaning apparatus of box-like shape having a base for fixing to an air conditioner main body, a high voltage power source detachably mounted under the base, a back cover, and a front cover with air inflow holes that fits over the back cover. A dust collecting electrode and an ionizer consisting of a discharge electrode and a counter electrode are housed in the back cover.

There is a need for an air ionizer that can produce an ample quantity of negative ions while controlling the generation of ozone. It is also desirable that the electrodes of an ionizer can be readily serviceable or replaceable so as to prolong product life. The present invention was developed in consideration of these needs.

SUMMARY OF THE INVENTION

In one aspect, the invention provides an air ionizer electrode assembly comprising:

an inner electrode;

at least one outer electrode; and a dielectric barrier sandwiched between the inner electrode and the at least one outer electrode;

wherein said inner electrode has a continuous overall surface and the at least one outer electrode has a plurality of holes therethrough adapted to provide a plurality of ion generating points for generation of negative ions.

The air ionizer electrode assembly of this invention allows the generation of negative ions through a plurality of ion generating points, realized by the plurality of holes in the outer electrode(s) while controlling the generation ozone.

Having a highly conductive inner electrode, with a continuous overall conductive surface that is not apertured in its active region, allows for a lower voltage to be used to generate negative ions, without the voltage crossing the threshold where molecular oxygen breakdown occurs, and with it, controlling the generation of ozone. The lower voltage also generates less heat, which will result in energy efficiency.

In an embodiment, each of the holes in the outer electrode (s) has a central open space surrounded by a peripheral portion having multiple pointed edges.

For example, each of the holes may be configured in the shape of honeycomb, star or sun elements.

In one embodiment, all of the holes have the same shape.

In one embodiment, the holes are in the form of 3-dimensional structures.

The holes in the form of a local 3-dimensional structure may be formed by a forming process.

Another alternative is the holes are provided on a raised plateau surface of the outer electrode formed by a stamping process.

The holes may be arranged in a regular pattern or array, or irregularly.

In the case of a metal sheet outer electrode, the holes may be formed by stamping.

The inner and/or at least one outer electrode may comprise metallic sheet, such as metal foil or plate. For example, nickel plate, copper or other metal sheets are suitable for use as the inner electrodes, whereas nickel plate, stainless steel or similar materials are suitable for use as the outer electrode(s).

In one embodiment, the inner and outer electrodes comprise different materials. For example, the inner electrode may comprise nickel and the outer electrode may comprise stainless steel.

The thickness of the inner electrode may range from 0.1 mm to 0.2 mm. The thickness of the or each outer electrode may range from 0.1 mm to 0.5 mm.

The inner and/or at least one outer electrode may further comprise a conductive coating formed on the metallic sheet. For example, the at least one outer electrode may comprise stainless steel plate with a conductive coating applied thereto.

Such a conductive coating may be used to coat the one or more outer electrodes to control ozone production.

Alternatively, the inner and/or at least one outer electrode may consist of such a conductive coating. In this case, the conductive coating may be deposited on a surface of the dielectric barrier. In the case of an outer electrode, the coating is subsequently etched to form the plurality of holes.

The conductive coating is suitably graphite-based. An example is a one-component, solvent-based dispersion of semi-colloidal graphite in a thermoset. Another example of the conductive coating is a dispersion of finely divided graphite pigment in an epoxy resin solution. The conductive coating thickness may suitably be in the range from 12 to 25 microns, for example.

A plate of ceramic, glass or other dielectric substrate is used as a dielectric barrier to separate the inner electrode from the one or more outer electrodes. The thickness of the material of the dielectric barrier may range from 0.2 mm to 1.5 mm.

In one embodiment, the electrode assembly is of generally planar configuration. There may then be two outer electrodes, one to each side of the planar inner electrode and each separated from the inner electrode by a respective dielectric barrier. Alternatively, there may be just one outer electrode, to one side of the inner electrode.

In another embodiment, the electrode assembly is of generally cylindrical configuration.

The electrode assembly may comprise a modular casing for housing the electrodes and dielectric barrier.

The electrodes suitably comprise connection terminals that are accessible through the casing.

In another aspect, the invention provides an air ionizer comprising an electrode assembly as described herein and a drive circuit for applying a control voltage to the electrodes.

The inner electrode, dielectric barrier(s) and at least one outer electrode are suitably encased within a modular casing with integrated contact elements to allow connection of a drive circuit for applying a control voltage to the electrodes. A drive circuit that provides the necessary alternating high voltage for generation of ions is known in the prior art and so does not need elaboration herein.

In an embodiment, the casing comprises two components that fit together to hold the electrode and dielectric layers in place, and having at least one window to expose the ion generating holes of the outer electrode.

Using inner and outer electrodes of different materials for example, and/or adjusting their relative dimensions, provides the flexibility to vary and control the output of ions and ozone depending on application. The outer electrode can be made of varying combinations of conductive coating, nickel or stainless steel. The inner electrode is either a conductive coating or metal sheet, or a metallic sheet coated with a conductive coating. Varying the composition and/or thickness of the inner electrode will alter the characteristics of the negative ion generation by the outer electrodes.

BRIEF DESCRIPTION OF THE DRAWINGS

The present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, the scope of which is to be determined by the appended claims.

In the accompanying drawings, like reference numerals are used to denote like parts throughout the several views.

FIGS. 3*a*-3*d* are planar views of various examples of configurations of the outer electrodes of the electrode assembly of FIGS. 1 and 2;

FIG. 7 is a perspective view of an assembled state of the air ionizer electrode assembly of cylindrical configuration.

DETAILED DESCRIPTION OF THE EMBODIMENTS

Figure 1:
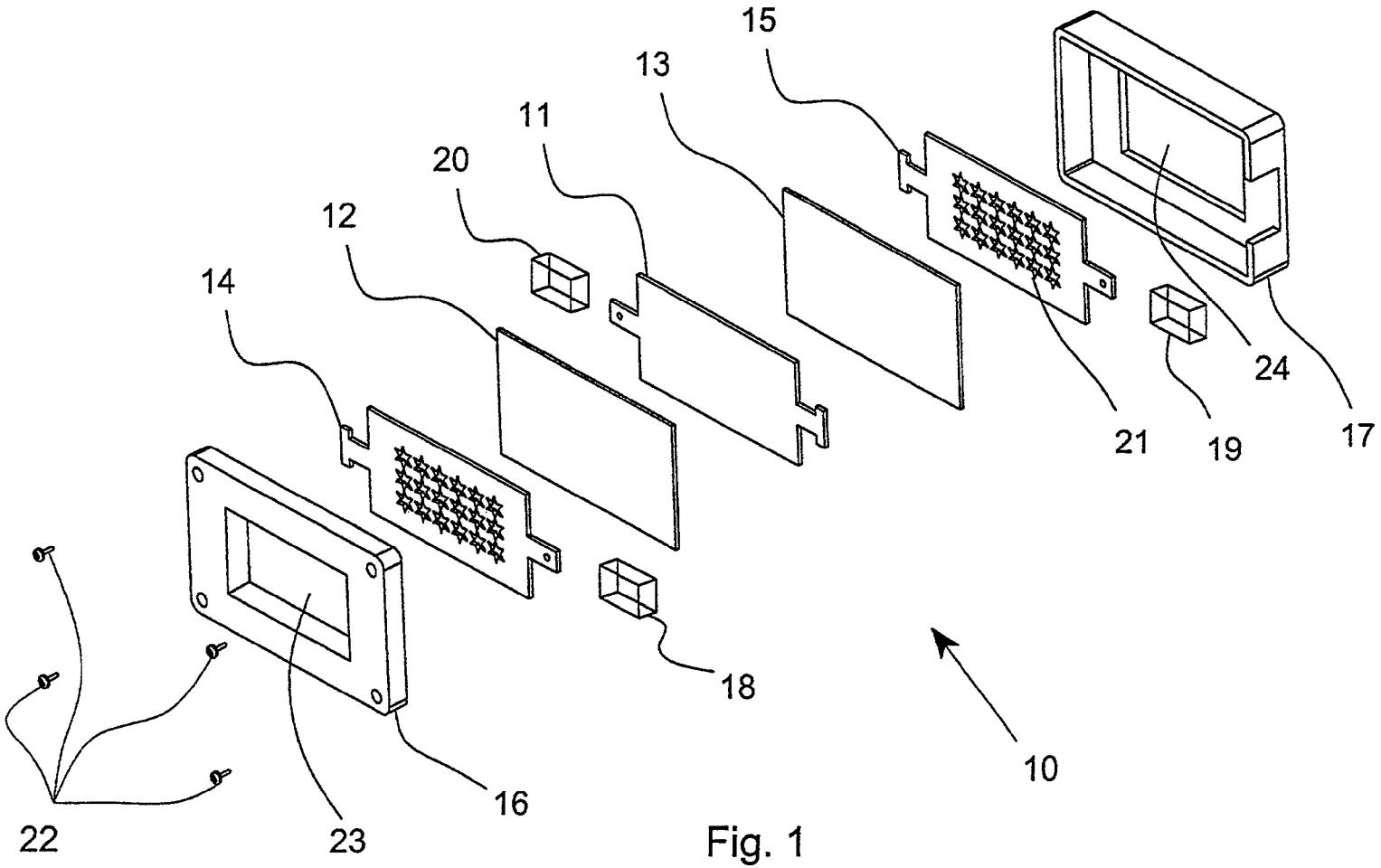
FIG. 1 is a perspective exploded view of construction of an air ionizer electrode assembly of planar configuration.

FIG. 1 illustrates, in an exploded perspective view, an electrode assembly 10 of planar configuration with the components of one inner electrode 11, two outer electrodes 14, 15 and two dielectric barriers 12, 13 arranged in parallel which are encased in a modular casing 16, 17.

The inner electrode 11 and outer electrodes 14, 15 are metallic sheets. In this case, a nickel plate of 30 mm×20 mm×0.2 mm is used as an inner electrode 11. Two stainless steel plates of 30 mm×20 mm×0.2 mm are used as outer electrodes 14, 15. Two ceramic plates of 40 mm×26 mm×0.8 mm are used as dielectric barriers 12, 13 to separate the inner electrode 11 from each of the outer electrodes 14, 15. The combination of the inner 11 and outer electrodes 14, 15 generates negative ions in the surrounding air. On each side of the inner electrode 11, one outer electrode 14, 15 facing the inner electrode 11 is separated by one dielectric barrier 12, 13.

The inner electrode 11 has a continuous overall surface without any apertures or holes over its active area. Each of the outer electrodes 14, 15 has a plurality of holes 21 to provide multiple ion generating points for generation of negative ions, as will be described in greater detail later on. In this embodiment, there are 18 holes 21 on the outer electrodes 14, 15.

One end (seen on the right-hand side in FIG. 1) of the inner electrode 11 has a T-shaped tab, which enables the electrode to be fitted to the modular casing 16, 17, whereas the other end (seen on the left-hand side) of the inner electrode 11 has a uniform width tab to which a contact element 20 for connecting a drive circuit can be suitably fitted.

Similarly, one end of each outer electrodes 14, 15 is made in the shape of a T-shaped tab to be fitted to the modular casing 16, 17 as well. The other end of each outer electrode 14, 15 provides a uniform width tab for a contact element 18, 19 to be suitably fitted on.

Figure 2:
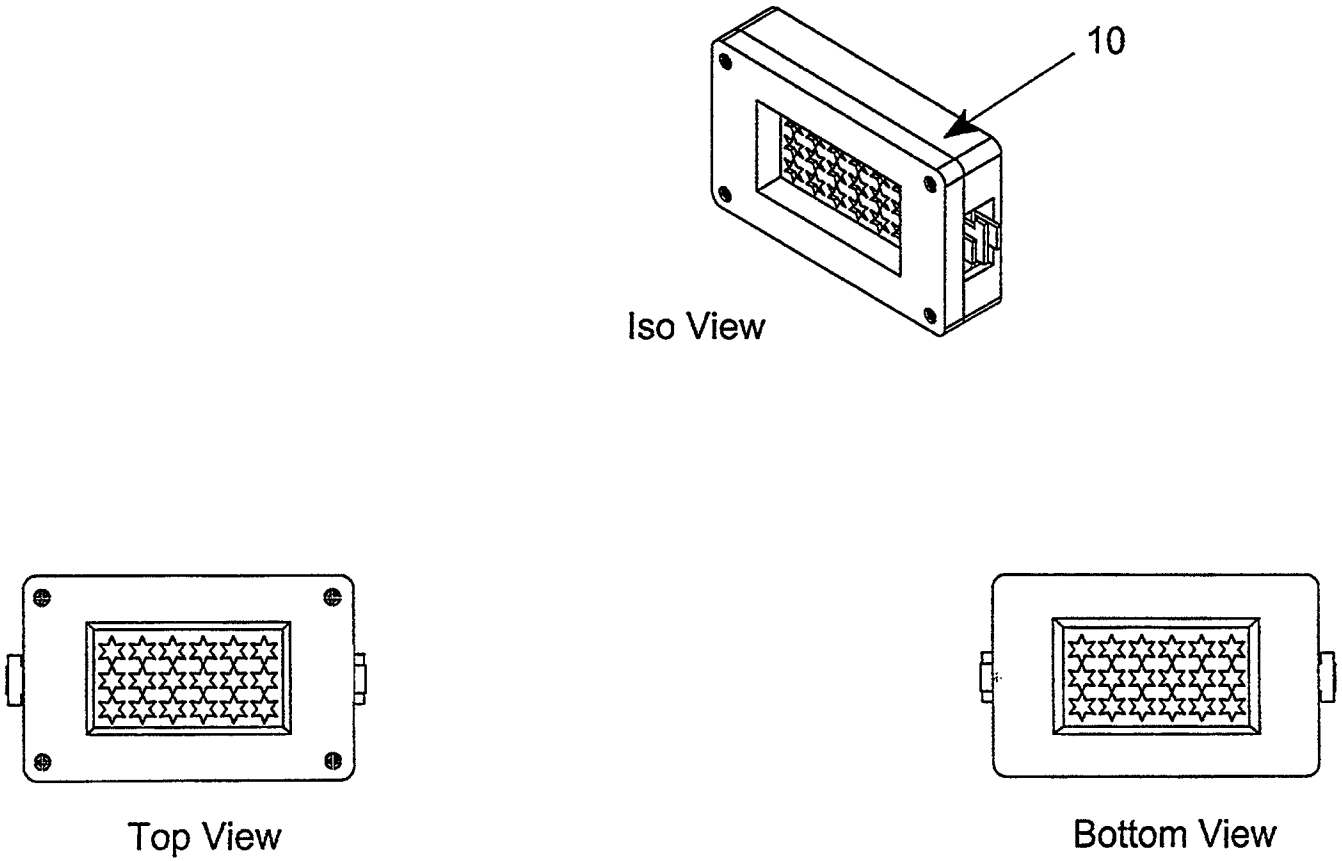
FIG. 2 shows various views of the electrode assembly of FIG. 1 in its assembled state.

FIG. 2 illustrates, in various views, a modular casing of a rectangular shape that includes two covers 16, 17 used to encase the components of the electrode assembly. The compartments inside the covers are configured with clearance to receive the electrode assembly components that are dielectric barriers, outer electrodes, inner electrode and contact elements.

As will be understood from the drawings and the above-mentioned dimensions, the two ceramic plates are designed to be a relatively snug fit within frames defined by the inner structure of the covers. On the other hand, the electrodes are undersized relative to the ceramic plates. The electrodes are located centrally of the ceramic plates using their end tabs.

Each of the covers 16, 17 has a window-like opening 23, 24 to expose the ion generating holes of the outer electrode. Screws 22 are used to secure the two covers of the casing to form an enclosure. Obviously, other means such as a snap-lock fit may be used to secure the casing covers together. The design of the integrated contact elements within the modular casing easily enables a separate power module to be connected to power the electrode assembly using standard connectors.

A conductive coating is used to provide a conductive and chemical-resistant coating and has high solvent resistance properties. In this embodiment, Dag® EB-815 is the coating used for this purpose. This coating is manufactured by Acheson Industries, Inc. For the physical properties, Dag® EB-815 has a viscosity of 1500-4000 mPa·s and density of 1.14 kg/l. The thickness of the coating may range from 12 microns to 25 microns. The coating has the ability to control the generation of ozone. The surface of both sides of the inner electrode 11 is fully coated with the conductive coating. The surfaces of the outer electrodes 14, 15 may be partially or fully coated. For the partially coated outer electrode, only some and not all of the surface area of the outer electrode containing the holes is coated with the conductive coating. However, in the case of either full or partial coating, the coating is only applied to the surface of the outer electrode 14, which faces outward through the window 23, 24 of the covers 16, 17 of the modular casing.

Another coating manufactured by the same manufacturer may alternatively be used, Dag® 213. For the physical properties, Dag® 213 has a viscosity of 2800 mPa·s and density of 0.98 kg/l.

FIG. 3 illustrates some possible configurations of the holes in the outer electrodes. The holes for the outer electrodes in the embodiment of FIGS. 1 and 2 above are configured in the stars configuration, as shown in FIG. 3*a*. Another form of star-shaped hole is shown in FIG. 3*b*, where the pointed edges include larger internal angles than those of the FIG. 3*a* version. FIG. 3*c* shows a honeycomb configuration of holes that are of hexagonal shape and arranged in a regular array. FIG. 3*d* shows holes of sun-shaped configuration, defined by a central circular hole surrounded by generally radially directed pointed edges like the rays of a sun.

Figure 4:
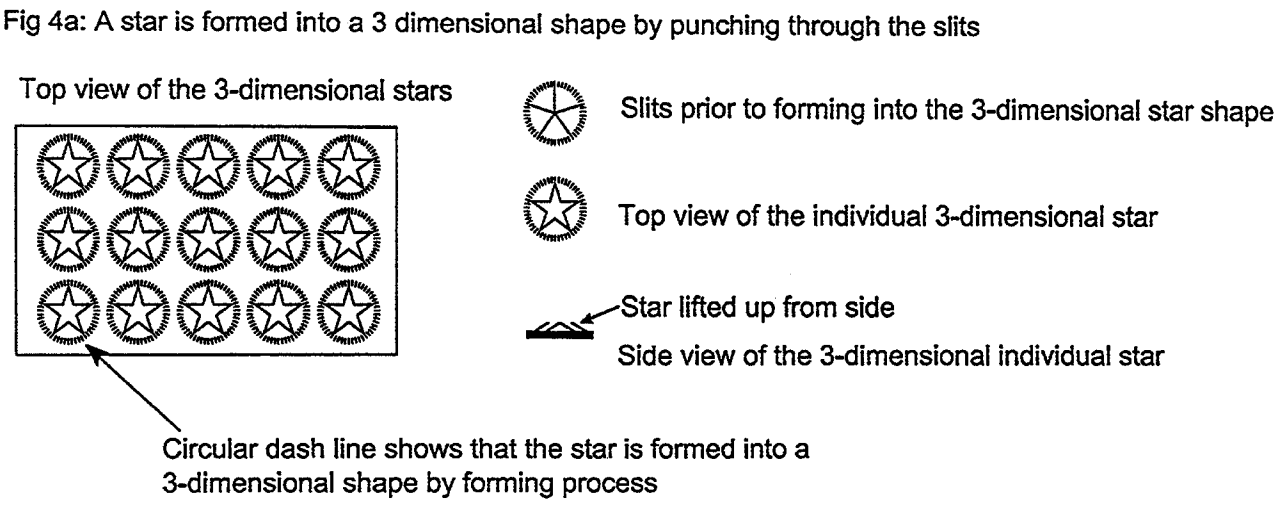
FIG. 4 shows different examples of 3-dimensional shapes of configurations of the outer electrodes of the electrode assembly of FIGS. 1 and 2.
Figure 4:
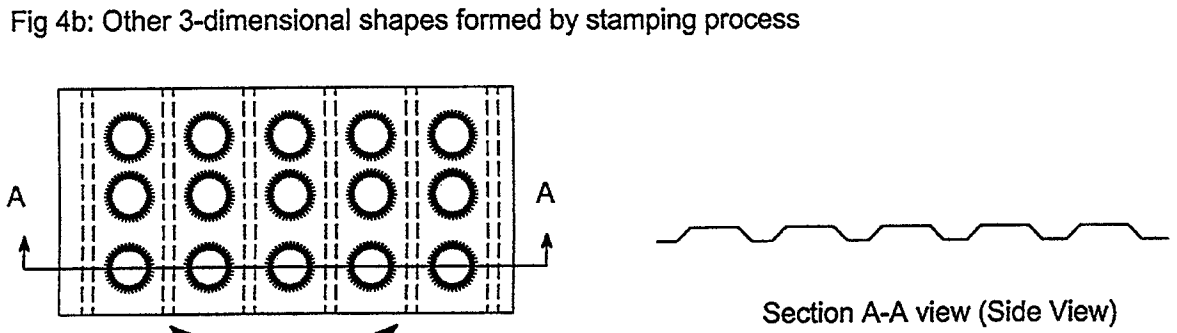

FIG. 4 illustrates other possible configurations of the holes in the outer electrodes in the form of 3-dimensional structures that define the holes. These can be used as alternatives to a generally planar hole or a generally planar outer electrode.

FIG. 4*a* shows 3-dimensional star structures. Slits are first formed as a set of radial cuts of a circle. The 3-dimensional star structures are then formed by punching through the slits whereby the pointed edges of the star formed by sectors of the circle are protruded from the surface at an inclined angle. The pointed edges protrude outside of the surface area of the outer electrode 14, 15 that faces the window 23, 24 of the modular casing.

FIG. 4*b* shows another 3-dimensional configuration formed by a stamping process. A plateau surface of the outer electrode 14, 15 is first formed that is raised relative to the original surface, by a stamping process creating a 3-dimensional structure. The raised plateau surface of the outer electrode 14, 15 faces the window 23, 24 of the modular casing. Each plateau surface is then subsequently pressed to form the plurality of holes. The holes are formed in channels with a row or column of holes per channel, on the surface of the outer electrode 14, 15.

The above example configurations of the outer electrode holes may be used in any embodiment of the present invention. Generalizing, each hole has a central open space surrounded by a peripheral portion having multiple pointed edges. Without wishing to be bound by theory, it is believed that the pointed edges of the different shapes are significant in generating the negative ions. Thus, other shapes and structures meeting these criteria can also be used with the invention.

Alternatively, another embodiment has the same configuration as shown in FIGS. 1 and 2 of one inner electrode, two outer electrodes and two dielectric barriers arranged in parallel and encased in a modular casing. In this embodiment, the surfaces of the outer electrodes are fully coated with the conductive coating.

Figure 5:
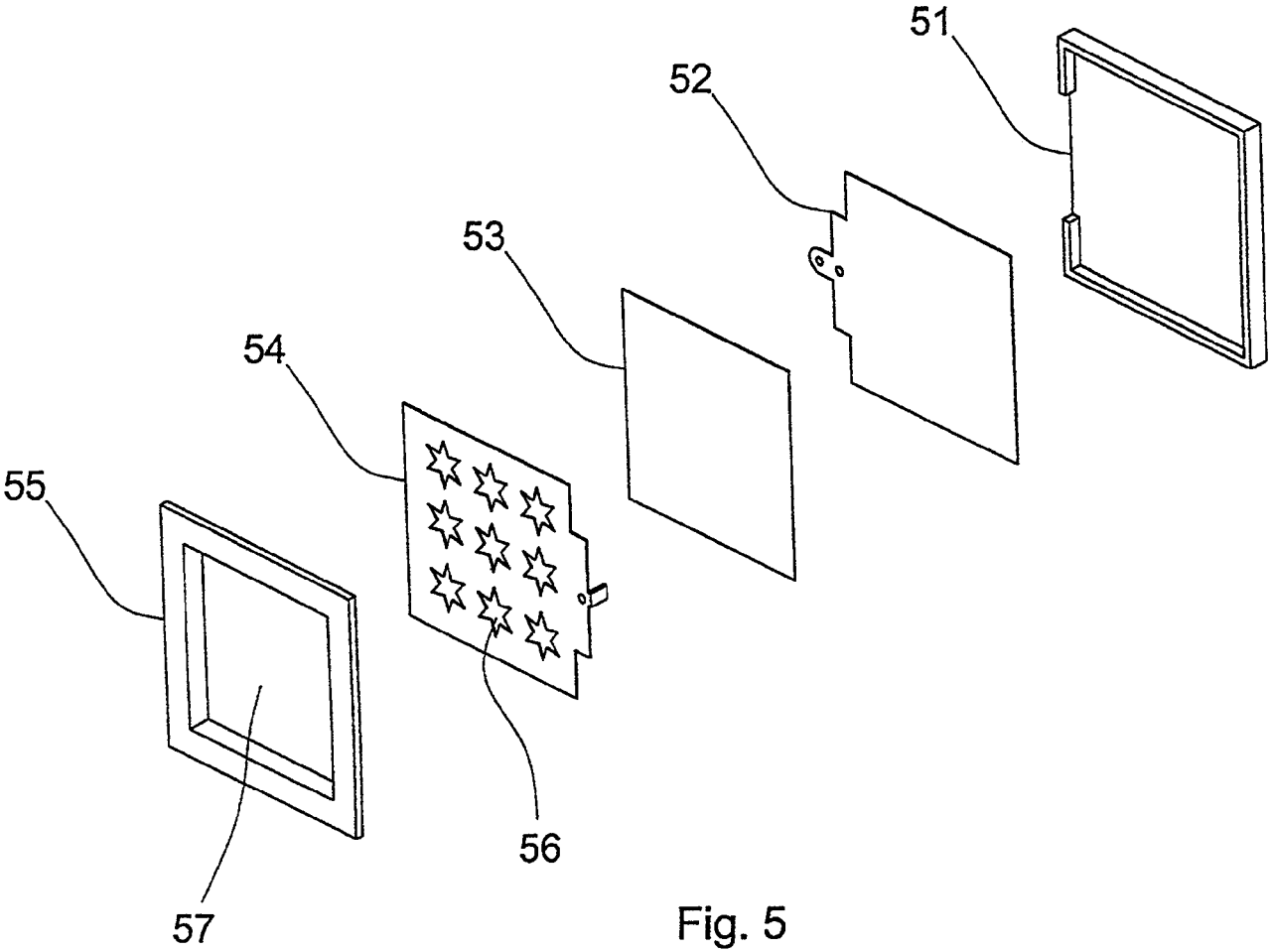
FIG. 5 is a perspective view of a modification to the air ionizer electrode assembly.

FIG. 5 illustrates, in perspective exploded view, a second embodiment 50 which includes the components of one inner electrode 52, one outer electrode 54 and one dielectric barrier 53, arranged in parallel which are encased in a modular casing 51, 55. The inner electrode 52 and outer electrode 54 are metallic sheets. In this case, a nickel plate of 16 mm×15 mm×0.15 mm is used as the inner electrode 52. A stainless steel plate of 16 mm×14.5 mm×0.15 mm is used as the outer electrode 54. One ceramic plate of 21 mm×16 mm×0.5 mm is used as a dielectric barrier 53 to separate the inner electrode 52 from the outer electrode 54.

The outer electrode 54 is placed on one side of the inner electrode 52, separated by the dielectric barrier 53. The inner electrode 52 has a continuous overall surface without any apertures or holes over its active area. The outer electrode 54 has a plurality of holes 56 to provide multiple ion generating points for generation of negative ions. In this embodiment, there are 9 holes on the outer electrode 54. The holes 56 for the outer electrode 54 in this embodiment are configured in the stars configuration. The modular casing includes two covers 51, 55 used to encase the components of the electrode assembly. One cover 55 has a window-like opening 57 to expose the ion generating holes of the outer electrode, while one cover 51 has a solid wall to prevent exposure of the inner electrode 52. The covers 51, 55 which are of non-conductive material function as insulators. In this embodiment 50, only one side of the inner electrode 52 with an outer electrode 54 and a dielectric barrier 53 is able to generate ions. The surface of the inner electrode 52 is fully coated with the conductive coating. However, the coating is only applied to the surface of the inner electrode 52 which faces the dielectric barrier 53 and outer electrode 54. The surface of the outer electrode 54 is partially coated. However, the coating is only applied to the surface of the outer electrode 54 which faces outward through the window 57 of the cover 55 of the modular casing.

Alternatively, another embodiment has the same configuration but the surface of the outer electrode is fully coated with the conductive coating.

Another modification of the present embodiment is the configuration with an inner electrode and two dielectric barriers. The inner electrode is a metallic sheet which has a continuous overall surface without any apertures or holes. The outer electrodes are realised as conductive coatings formed on the dielectric barriers that are placed one to each side of the planar inner electrode. The conductive coating may be deposited on a surface of the dielectric barriers and is subsequently etched to form the plurality of holes.

In one embodiment, the electrode assembly is of generally planar configuration. There may then be two outer electrodes, one to each side of the planar inner electrode and each separated from the inner electrode by a respective dielectric barrier. Alternatively, there may be just one outer electrode, to one side of the inner electrode.

The planar configuration embodiments that have only one outer electrode are suitable for applications such as where the electrode module is to be fitted generally flat to a wall, such as a cabinet wall. On the other hand, the two-outer-electrode versions are suitable for mounting perpendicularly to a cabinet wall whereby ions can be generated and freely released from both sides of the module.

Figure 6:
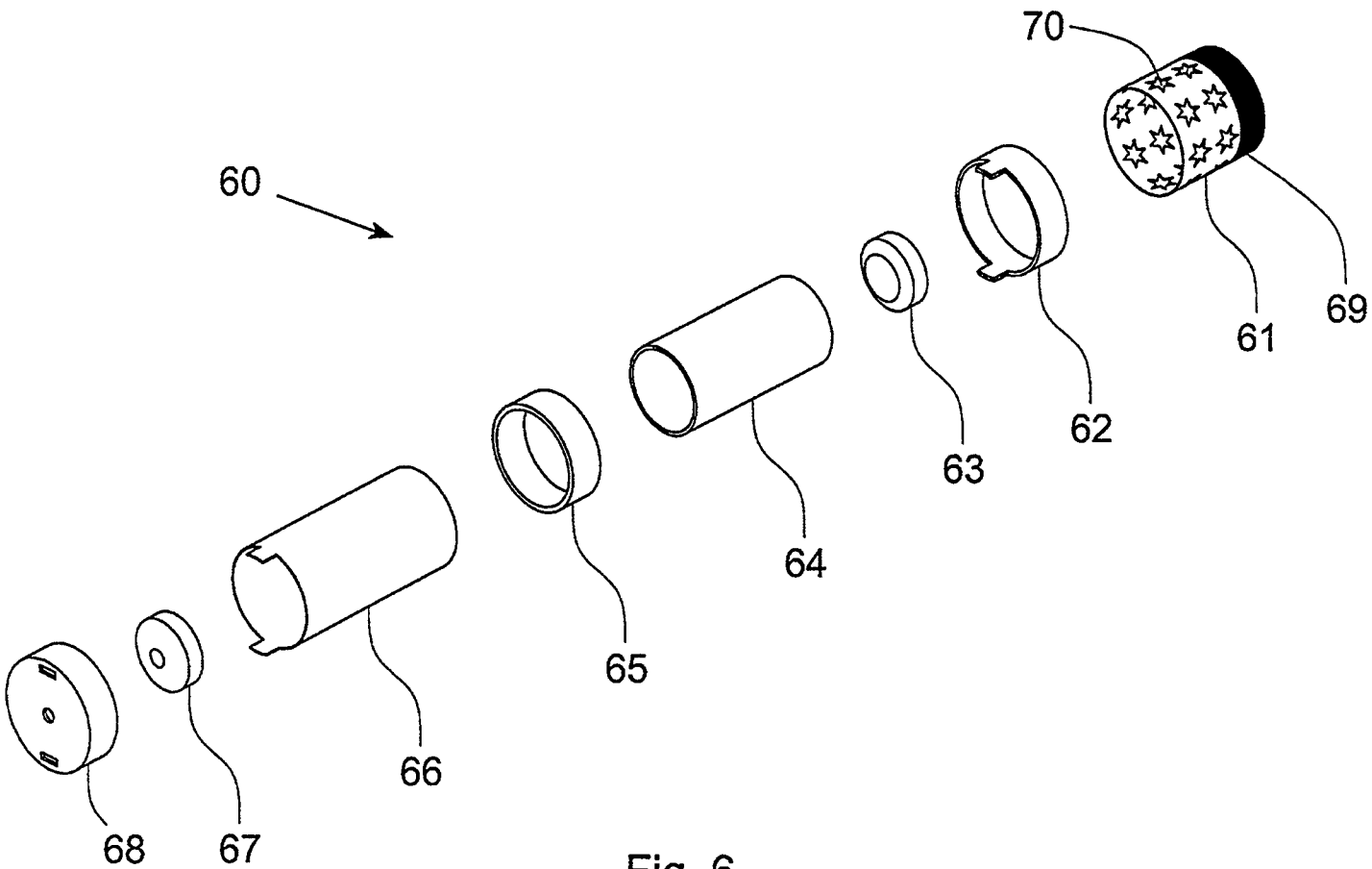
FIG. 6 is a perspective view of an air ionizer electrode assembly of cylindrical configuration.

A third embodiment as illustrated by FIG. 6 in a perspective view is an electrode assembly 60 of generally cylindrical configuration. The main components are an inner electrode 66, an outer electrode 61, a dielectric barrier 64, an insulator 65, two contact caps 62, 68 and two bushes 63, 67. The outer electrode 61 has a plurality of holes 70 to provide multiple ion generating points for generation of negative ions. The holes may take any of the forms described already.

The inner 66 and outer electrode 61 are separated by the dielectric barrier 64. The inner electrode 66 is first inserted into the dielectric barrier 64. The rubber bushes 63 and 67 are then inserted into the respective ends of this arrangement of the inner electrode 66 and dielectric barrier 64. This arrangement of dielectric barrier 64, inner electrode 66 and rubber bushes 63 and 67 is encapsulated at one end by a contact cap 68. The insulator 65 and outer electrode 61 are then slid over the outside of the dielectric barrier 64. The insulator 65 insulates the contact cap 68 from the outer electrode 61. The other end of this arrangement of inner 66 and outer electrode 61, dielectric barrier 64, rubber bushes 63, 67, insulator 65 and end cap 68 is further encapsulated by contact cap 62. The inner surface of the dielectric barrier 64 where the inner electrode 66 is located provides an air tight or vacuum chamber to protect the inner electrode 66 against oxidation and/or corrosion. Optionally, the outer electrode 61 is partially 69 or fully coated (not shown) with a conductive coating.

Another modification of the present embodiment is the configuration with an inner electrode and a dielectric barrier. The outer electrode is realised as conductive coating formed on the outer surface of the dielectric barrier.

Another modification of the present embodiment is the configuration with an outer electrode and a dielectric barrier. The inner electrode is realised as conductive coating formed on the inner surface of the dielectric barrier.

Alternatively, the functions of the inner and outer electrodes can each be realized as conductive coating formed on the inner and outer surfaces of the dielectric barrier.

The inner electrode 66, outer electrode 61 and dielectric barrier 64 in the shape of cylinders generate a more uniform distribution of ions as compared to a planar configuration resulting in better distribution of negative ions in the surrounding air. The cylindrical configuration allows the ions to be spread 360 degrees evenly about the electrode assembly 60.

The embodiments in accordance with the invention can be scaled to a size to suit the application of the user. The electrode assembly incorporated into an ion generating module offers the flexibility of scaling the size of the module depending on the application needs by varying the dimensions of the components accordingly.

The electrode assembly includes a combination of an inner electrode with no apertures or holes, at least one outer electrode with a plurality of holes, and at least one intervening dielectric barrier to generate the desired negative ions.

The electrode module of this invention can be incorporated to an ion generating product. The modularity of the present invention will increase its usability and allow an ion generating product to have single or multiple ion generating modules to increase its ion production to cater to different market needs, whether consumer, commercial or industrial. Multiple electrode modules may be connected to one or more power modules.

While an air ionizer that uses one or more electrode modules in accordance with the invention will offer a longer service life than the traditional pin-type ionizers, the or each module can be readily replaced by simply unplugging the module from the drive circuitry, removing and replacing it. It is also possible to readily disassemble the components of the electrode module for cleaning and/or replacement of the electrode and dielectric components as necessary. The serviced module can then be easily reinstalled and reconnected.

The invention may also be embodied in many ways other than those specifically described herein, without departing from the scope thereof.

The invention claimed is:

1. An air ionizer electrode assembly comprising:
an inner electrode;
at least one outer electrode; and
a dielectric barrier sandwiched between the inner electrode and the at least one outer electrode;
wherein said inner electrode has a continuous overall surface and said at least one outer electrode has a plurality of holes therethrough adapted to provide a plurality of ion generating points for generation of negative ions;
wherein each of said holes has a central open space surrounded by a peripheral portion having multiple pointed edges.

2. An electrode assembly according to claim 1, wherein each of said holes is configured in the shape of honeycomb, star or sun element.

3. An electrode assembly according to claim 1, wherein each of said holes is defined by a local 3-dimensional structure of the outer electrode.

4. An electrode assembly according to claim 1, wherein each of said holes is provided on a raised plateau surface of the outer electrode.

5. An electrode assembly according to claim 1, wherein at least one of said inner and at least one outer electrode comprises metallic sheet.

6. An electrode assembly according to claim 5, wherein said at least one of said inner and at least one outer electrode further comprises a conductive coating formed on said metallic sheet.

7. An electrode assembly according to claim 1, wherein at least one of said inner and at least one outer electrode comprises a conductive coating.

8. An electrode assembly according to claim 7, wherein said conductive coating is formed on a surface of said dielectric barrier.

9. An electrode assembly according to claim 1, wherein the electrode assembly is of generally planar configuration.

10. An electrode assembly according to claim 9, wherein there are two said outer electrodes, each separated from the inner electrode by a respective said dielectric barrier.

11. An electrode assembly according to claim 9, wherein there is one said outer electrode, on one face of the dielectric barrier.

12. An electrode assembly according to claim 1, wherein the electrode assembly is of generally cylindrical configuration.

13. An electrode assembly according to claim 1, further comprising a casing for housing the electrodes and dielectric barrier.

14. An electrode assembly according to claim 13, wherein the electrodes comprise connection terminals that are accessible through the casing.

15. An air ionizer comprising
an electrode assembly comprising:
an inner electrode;
at least one outer electrode; and
a dielectric barrier sandwiched between the inner electrode and the at least one outer electrode;

wherein said inner electrode has a continuous overall surface and said at least one outer electrode has a plurality of holes therethrough adapted to provide a plurality of ion generating points for generation of negative ions;

wherein each of said holes has a central open space surrounded by a peripheral portion having multiple pointed edges; and a drive circuit for applying a control voltage to the electrodes.

* * * * *